United States Patent [19]

Christensen

[11] Patent Number: 4,663,559

[45] Date of Patent: May 5, 1987

[54] FIELD EMISSION DEVICE

[76] Inventor: Alton O. Christensen, 1540 Diel Dr., Milpitas, Calif. 95035

[21] Appl. No.: 798,587

[22] Filed: Nov. 15, 1985

Related U.S. Application Data

[63] Continuation of Ser. No. 419,501, Sep. 17, 1982, abandoned.

[51] Int. Cl.[4] ..... H01J 1/16; H01J 19/10

[52] U.S. Cl. ..... 313/336; 75/230; 75/235; 313/346 R; 313/310; 313/633

[58] Field of Search ..... 313/336, 346, 310, 311, 313/331-335, 633; 419/10, 19; 75/230, 232, 235

[56] References Cited

U.S. PATENT DOCUMENTS

| | | | |
|---|---|---|---|
| 2,914,402 | 11/1959 | Becker et al. | 419/19 |
| 2,996,795 | 8/1961 | Stout | 419/19 X |
| 3,232,717 | 2/1966 | Hill et al. | 313/633 |
| 3,489,554 | 1/1970 | Waldo | 419/19 |
| 3,600,334 | 8/1971 | Koncz | 313/310 |
| 3,753,022 | 8/1973 | Fraser, Jr. | 313/311 |
| 4,038,216 | 7/1977 | Henrich et al. | 419/19 |
| 4,092,560 | 5/1978 | Puskas | 313/326 |
| 4,131,459 | 12/1978 | Phillips | 419/19 |
| 4,155,758 | 5/1979 | Evans et al. | 419/19 |

*Primary Examiner*—Saxfield Chatmon

[57] ABSTRACT

A device is disclosed which produces high current, low noise, low lateral energy, stochastic electron emission from a multiplicity of insulative particles subjected to a field. The insulative particles are in and of a surface thickness comprised of a random mixture of insulative and conductive particles in ohmic contact. Emission is achieved at applied potentials of about 5 volts which produce a field sufficient to emit electron currents of nanoamperes to milliamperes. Single devices or arrays of devices may be batch fabricated. Each device has an imtegral, implicity self-aligned electron optic system comprising means for modulating, focusing and deflecting the formed current beam, and means shielding the device from ambient magnetic fields.

24 Claims, 4 Drawing Figures

FIG.1
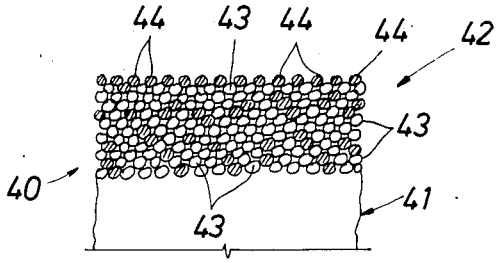
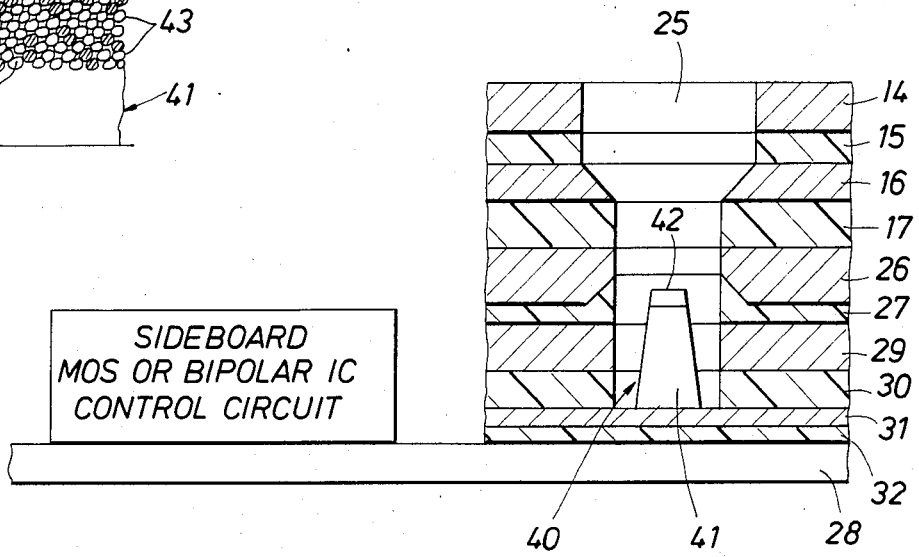
FIG. 2
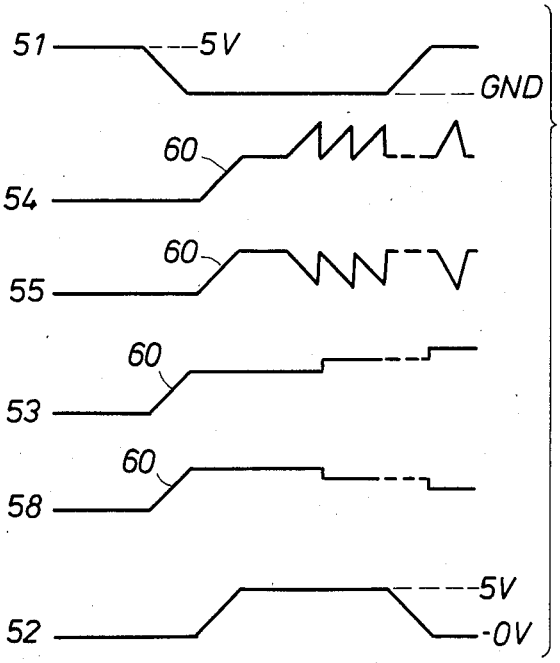
FIG. 3
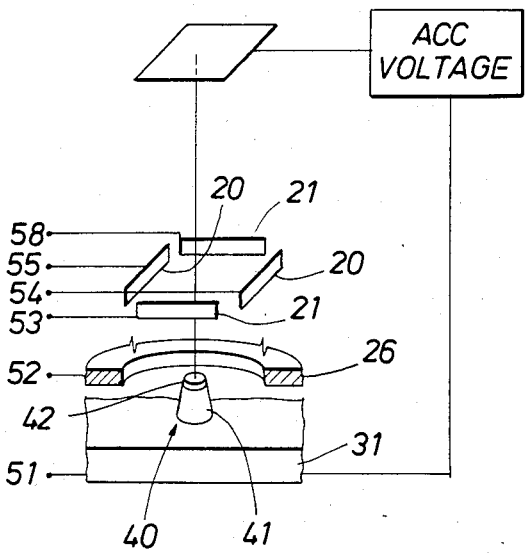
FIG. 4

FIELD EMISSION DEVICE

This disclosure is a continuation of Ser. No. 419,501 filed Sept. 17, 1982, now abandoned.

BACKGROUND OF THE DISCLOSURE

This disclosure sets forth a cold, field emission device, wherein low noise microampere electron currents are achieved at low fields, typically $5\times10^8$ volts/meter, from applied potentials of typically 4.85 volts, commonly available at a nominal value of 5 volts. Emission is across the less than 1 ev barrier from the conduction band of a multiplicity of insulator particles in ohmic contact with conductor particles. The multiplicity of insulator particles emits in a stochastic manner, increasing the current-plus-noise to noise ratio by at least 20 decibels over the prior art devices.

Exemplary field emission devices are set forth in the patents of Fraser, U.S. Pat. No. 3,735,022 and Spindt, U.S. Pat. No. 3,755,704 which disclosures reveal molybdenum as the emitter material. Copper emitter materials are shown in Levine, U.S. Pat. No. 3,921,022. Redman, U.S. Pat. No. 3,982,147 and Shelton, U.S. Pat. No. 4,163,198 utilize metal fibers. Fukase, et al, U.S. Pat. No. 3,998,678 discloses an emitter of lanthanum hexaboride or other rare earth borides. The patent of Hosoki, U.S. Pat. No. 4,143,292 discloses carbon used as a metal. In all the prior art typical fields of at least $5\times10^9$ volts/meter are applied, to raise sufficient electrons from the metal Fermi level, 2.3 ev to 4.5 ev, to vacuum level. The barrier (a range of 2.3 ev to 4.5 ev) to emission is the range typified by all the prior art including the work function of rare earth borides through tungsten metal. The quotient, the work function to the 3/2 power divided by the applied field, is part of the negative exponent of the exponential expression for the probability of emission. Such high fields, in excess of that required to overcome the surface tension of the material, cause protruberances ("whiskers") to grow from the emitting surface. The enhanced field about a whisker makes the whisker the source of emission. The relatively large geometries and work functions of the prior art require potentials of 50 volts to 2,500 volts to produce the required field to both produce and emit from a whisker. Such high potentials produce electron energies many times that required to ionize gas molecules. This disclosure is directed to emission from a multiplicity of insulative particles having an exemplary reduced 0.85 ev barrier to emission, requiring typically a field of $5\times10^8$ volts/meter obtained from a potential under 5 volts. Such a low field is insufficient to cause the growth of whiskers. Such low potential (e.g., 5 volts) produces electrons with insufficient energy to ionize gasses.

The emitting device volume of all prior art structures is relatively large such that millions of gas molecules are available to collision with emitted electrons, causing beamspreading. Notwithstanding the nanotorr vacuum required in all prior art devices, millions of gas molecules remain and are available to be ionized in the vicinity of field emitters. Such ionized gasses are attracted to and ablate, or adsorb onto, the emitter surface instantaneously changing the work function by changing the surface composition. The changes in work function modify the emitted current. That change, instability, in emitted current is the "burst noise" of all the prior art. The ion ablation of the very small whisker emitting surface results in short operating life. The volume of the structure of the present disclosure accessible to vacuum is very small, such that at 10 microtorr vacuum, not more than 3 gas molecules remain in the total volumetric space. The potentials between elements of the present disclosure device are less than the ionizing potential of residual or diffusing gasses. Thus, the 3 or fewer gas molecules in the volume are neither ionized nor initiate significant collision scattering nor spreading of the beam. The absence of burst noise of the present disclosure device further increases the current to noise ratio as compared to the prior art. The ability of the device of the present disclosure to operate at 10 microtorr vacuum level, as compared to typically 1 nanotorr of prior art devices is an additional economy, reducing the cost of vacuum systems.

In the device of the present disclosure, the energy and velocity of the emitted electrons is low. Such low velocities, together with low lateral energy, make focus and deflection by electrostatic means in micron dimensions feasible. Prior art devices commonly require large electromagnets for focusing the emitted electrons, part of the reason for their large volume. The present disclosure features low velocity electrons highly sensitive to low intensity steering fields. An optional feature to overcome emitted electrons sensitive to ambient magnetic fields and part of the disclosed structure is a high strength, low induction magnet with an aperture centered upon the emitting surfaces. The magnet dominates ambient fields, and produces field lines parallel to and within the emission axis. Those field lines additionally steer ions, created in any exterior acceleration space, away from the emitting surfaces.

The maximum width of the energy distribution of the device of the present disclosure is less than 0.09 ev, about one-tenth that of prior art devices. A narrower distribution of emitted electron energy results in a smaller, better defined beam diameter.

The device of the present disclosure is amenable to manufacture in batches, using process steps also used in the making of semiconductor integrated circuits. All elements of the device, including implicitly self-aligned electron optical elements are fabricated in such an economic process. The prior art devices normally require hand fabricated and assembled focus and deflection elements and are not amenable to the economies of batch manufacturing.

BRIEF SUMMARY OF THE PRESENT DISCLOSURE

This disclosure sets forth a cold field emission device. Insulator and conductor particles are deposited as a random mixture to about 200 Angstroms thickness and form the tip of a conical structure having a base formed of the conductive material. The insulative and conductive materials are chosen such that the work function of the insulator is greater than the work function of the conductor. That work function difference defines ohmic contact between the materials. In the band diagram of ohmic contact, the Fermi levels of the materials must align and the vacuum level must be continuous. In non-ohmic, barrier, contact between materials, the vacuum level has a discontinuity, a barrier where height is the difference in work function. An insulator conduction band is normally empty of electrons. In ohmic contact, in order to maintain charge neutrality and not produce a source of energy because of the work function difference, equilibrium requires the conductive particles to inject electrons into the insulative particles conduction band. The barrier to emission of electrons from the conduction band is the electron affinity (conduction band width) of the insulator material, typically 1 ev or less. Those injected free electrons in the conduction band of the insulator particles have a Fermi-Diurac distribution, with most free electrons near the conduction band bottom.

The electrode tip is surrounded by an extractor electrode, a ring-like elevated conductive structure, connected to a positive potential. The base of the conical structure is connected to ground potential. The potential applied to the extractor electrode produces a field acting on the electrode tip. Since the insulator particles are made protruberances of the surface, the field around each insulator particles is enhanced as in the case of a whisker.

The field is sufficient to cause insulator particles, in and of the surface of the tip, to emit electrons over the 1 ev or less barrier into vacuum. This low intensity field is not sufficient to cause growth of other (unwanted) protruberances. Equilibrium requires the conductor particle(s) in ohmic contact to inject electrons to replace those emitted from the surface. Since a multiplicity of insulator particles are under the influence of the field, each such particle emits electrons at a random time, in a stochastic process. Extractor potentials in the approximate range of 3.5 volts to 8.5 volts produce electron currents of nanoamperes to milliamperes depending on a variety of scale factors. The energy and velocity of the emitted electrons are low. The structure disclosed includes means to shield the electrons from the effects of ambient magnetic fields.

The volume of the structure accessible to the adjacent vacuum space is very small, say, in the range of 10 microtorr vacuum, such that not more than 3 gas molecules are randomly located in the volume defined by the structure. The potentials between elements are less than the ionizing potential of residual or diffusing gasses. Thus, the 3 or fewer gas molecules in the volume are neither ionized nor create a significant collision scattering of the beam. Gas molecule location, being a random function, provides minimal beam scattering.

The structure disclosed includes: the emitting surface of insulative particles in ohmic contact with conductive particles; a conical base of the conductive material supporting the emitting surface; an apertured permanent magnet surrounding the conical base; an apertured element centered upon and surrounding the emitting surface to provide the positive terminal of the field potential and means for modulating the emitted electron current; electrostatic lense elements to focus the electrons into a beam; and, orthogonal elements to deflect the electron beam. The structure is suitable for manufacturing in batches in a semiconductor type process. Several thousand of the disclosed devices can be formed on a 4 inch diameter substrate. The substrate may be a silicon wafer.

Accordingly, the term "microgun" is applied to the completed assembly supported on a substrate. One method of fabrication is described in a patent entitled Batch Fabrication Procedure issued on Feb. 12, 1985 and bearing U.S. Pat. No. 4,498,952.

The preferred materials for the insulative particles are beryllia of work function 4.7 ev, or carefully prepared silica of work function 5 ev. The preferred materials for the conductive particles are the refractory compounds trichromium monosilicide of work function 2.58 ev, or tantulum nitride of work function 2.17 ev. Since the emitting surface is a mixture of refractory conductor particles in ohmic contact with refractory oxide particles, the mixture is thus a specifically defined cermet.

One target to be used with the electron beam is the memory device set forth in U.S. Pat No. 4,213,192 of the present inventor.

UNDERLYING PHYSICAL PRINCIPLES OF OPERATION OF THE DISCLOSED FIELD EMISSION DEVICES

Emission of electrons is produced by imposing a field on a multiplicity of insulative particles in and of the surface of a cermet. The particles are inevitably arranged in a random distribution of insulative and conductive commingled particles. A cermet is particularly found at the exposed top surface or tip of a pyramid or conic structure. The lower portion of the conic shape is ideally formed of conductive material from the materials used in the cermet. Accordingly, the pyramid can be simply described as having three regions; the lowermost region is the region which is adhered to the supportive conductive substrate. The next region is the central region formed of conductive material. The last region is the tip which is a mix of insulative and conductive particles, all in ohmic contact with adjacent particles. The work function of the particles of insulation exceeds the work function of the conductive particles to define an ohmic contact therebetween. Since ohmic contact exists, (1) the Fermi and vacuum levels of the two materials align at the contacting surface; (2) electrons are injected from the conductor into the conduction band of the insulator and fully accumulate the insulator conduction band; (3) the remaining barrier for emission into vacuum is at most the width of the conduction band, also called the "electron affinity" of the insulator and is less than 1 ev; (4) the application of a field to the insulative particles causes further injection of electrons and lowers the barrier to emission; (5) the barrier to emission is less than the Heisenberg uncertainty in the position of electrons in the conduction band, thus electrons can leave the conduction band into vacuum.

The geometry of the pyramid or tip is noteworthy; it comprises an upstanding pointed surface or tip surrounded by a conductive first anode in space. The anode is shaped in manufacture; suitable masks aid in shaping the conductive layer into the desired shape. The anode surrounds the tip and forms an aperture. The surrounding aperture is insulated from and spaced above the conductive substrate which supports the pyramid structure. Typically, the bottom or supportive substrate may be any insulating surface, or may be formed of N+ doped semiconductor material. On application of a positive potential to the first anode while maintaining the substrate at a negative or ground level, a field is created acting on the tip of the pyramid centered within the first anode. The field, as evaluated at the cermet tip portion, acts on the insulative particles, and initiates electron emission assuming that the field strength is sufficient. The bulk electron flow is from the substrate through the pyramid structure and to the cermet to fill all electron traps. Moreover, assuming the field is sufficient, the electrons flow through the conductive particles and the ohmic contacts with the insulative particles to initiate electron flow in the conduction band of the insulative particles. The field acting upon the conductive particles undergoes Schottky barrier lowering to enable continual and constant tunneling and flow of electrons from the metal through the conductive band into vacuum, the process occurring at a high level of probability. The barrier which is lowered by the field strength of sufficient amplitude is the width of the insulative particles conductive band, namely the electron affinity of the insulative material and that is typically in the range of less than 1.0 ev before Schottky lowering. The field required to fill all traps such that the additional field thereabove initiates electron flow in the insulative particles (in the conduction band thereof) is given by Simmons, *Journal of Physics,* vol. 4, 1971, p. 641, which states:

$$F_0 = qNL/2ee_o \text{ in volts/meters} = 3.2\times10^7\ V/M \quad (1)$$

where $F_0$=field required to fill all traps;

q=the electron charge;

N=the number of traps per cubic meter;

L=the average conductive dimension of insulative particles; and $ee_0$=is the permittivity of the insulative particles.

Typical values for these parameters are:

$N=1\times10^{25}$ traps per cubic meter;

$L=35\times10^{-10}$ m; and $ee_0=9.65\times10^{11}\ F/m$.

Once the field is exceeded, electron flow is in the conduction band of the insulative particles. The current density of the electron flow for an applied field F which exceeds the trap filled field $F_0$ by an amount $Fi=Fa-F_0$, is calculated for one insulative particle having a conductive dimension L according to the formulation proposed by O'Reilly, *Solid State Electronics,* vol. 18, 1975, p. 965, which equation has both an ohmic term and a space-charge limited term.

$$Js = s\ V/L + 9/8\ (\mu\theta e_0)\ V^2/L^3 \quad (2)$$

where

Js=current density in amperes/square meters;

$\mu$=the electron mobility in the insulative particle=$3\times10^5$ m$^2$/v sec for silica, and $3\times10^4$ m$^2$/v sec for beryllia;

s=the conductivity;

$\theta$=electron diffusion coefficient of 1.4;

$ee_0$=permittivity of the insulative particle=$3.8\times10^{-11}$ F/m for silica, and $5.6\times10^{-11}$ F/m for beryllia;

Fi=the effective field strength in volts per meter=$5\times10^8$ V/m;

V=voltage acting on an insulative particle; and

L=the average conductive dimension of the insulative particle.

The ohmic first term of equation (2) is much smaller than the second or conduction term, and therefore the first term may be neglected. Using the values represented above and 3.5 nanometer for L, the maximum source current density for a single silica particle is $2.48\times10^{11}$ amperes/m$^2$, and for beryllia particle $1.89\times10^{10}$ amperes/m$^2$. Current flows from each insulator particle of the tip.

Field emission is expressed as the product of the source current density Js, given by equation (2), and the probability of emission P. The expression for P can be found in the literature, and is:

$$P = \exp\ [(-B/Fi)\phi^{1.5}Vy] \quad (3)$$

where

B is a quantum mechanical constant=$6.83\times10^9$ m ev$^5$ $\phi$=the barrier to emission, 1 ev for silica, and 0.85 ev for beryllia;

Vy=the non-dimensional Schottky barrier lowering function, a function of the elliptical function Y; and $Y=1.44\times10^{-9}Fi/\phi^2$.

In cold field emission, the maximum value of Y is 1.0, and at Y=1.0, one has Vy=0.0 and P=1.0. Significant cold field emission is obtained when Y is greater than 0.6. In the present case, the total emitted current density is:

$$Je = N^*Js^*Pina/\text{m}^2 \quad (4)$$

where N is the number of emitting insulator particles. Each emitting particle yields a current approximate that of one whisker of the prior art.

The field emission device of the present disclosure, with a representative 250 insulator particles emitting with average L=3.5 nanometer, is compared to the prior art emitters at the same geometry and an equal emitted current density in the Table below. The emitted current density used for comparison, $7.41\times10^{10}$ amperes/m$^2$, is very near the maximum for cold emission for lanthanum hexaboride ($LaB_6$).

TABLE

COMPARISON OF PRESENT AND PRIOR ART EMISSION

| Material | Barrier | N | Field v/m | Y | Vy | P | Source a/m$^2$ |
|---|---|---|---|---|---|---|---|
| Mo | 4.35 ev | 1 | $9.83\times10^9$ | .8651 | .2151 | .258 | $2.87\times10^{11}$ |
| $LaB_6$ | 2.31 ev | 1 | $3.70\times10^9$ | .9998 | .0003 | .998 | $7.42\times10^{10}$ |
| Silica | 1.0 ev | 250 | $4.17\times10^8$ | .7746 | .3481 | .003 | $2.23\times10^{13}$ |
| Beryllia | 0.85 ev | 250 | $3.63\times10^8$ | .8501 | .2377 | .029 | $2.48\times10^{12}$ |

Comparing molybdenum (Mo) to silica and beryllia particles, molybdenum whiskers require 23.6 and 27 times the field, respectively, to obtain $7.41\times10$ amperes/m$^2$ emission. Or stated another way, molybdenum requires 23.6 or 27 times the applied voltage. Comparing lanthanum hexaboride to silica or beryllia particles, lanthanum hexaboride requires 8.9 or 10.2 times the field or applied voltage, respectively, to obtain $7.41\times10^{10}$ amperes/m$^2$ of emission.

In the case above of 250 emitting silica or beryllia particles, the emitted current is about 0.3 milliamperes, as compared to about 1 microamperes from the molybdenum whisker.

The field applied is dependent upon a geometric factor $\beta$ which converts the field from that between parallel plates to that about the surface of the cermet. The field is defined in the literature as:

$$Fi = \beta V \quad (5)$$

where

V is the applied voltage.

The geometric field factor $\beta$ for the worst case of the preferred embodiment is obtained from empirical data. An exemplary tip has insulator particles in and of the surface of a pyramid or conical structure having an apex angle of 60 degrees and tip radius between 50 and 90 nanometers. Smaller apex angles increase the geometric field factor. The geometric field factor is empirically:

$$\beta = 7.26 \times 10^7 (1.6 - 1.84x) a^{(-0.569)} \quad (6)$$

where x = the distance in micrometers between the top of the cermet and the plane of the bottom of the extractor anode, being positive if the tip is above, and negative if the tip is below that plane and; a = the diameter of the aperture in the extractor anode in micrometers.

Preferred values for the above factors are:

x = +0.15 micrometers, typical value; and a = 1.3 micrometers, typical value.

With the preferred values, the geometric field factor is about $8.87 \times 10^7$ m$^{-1}$ and the extractor anode potential required to produce the field of $4.17 \times 10^8$ v/m for silica particles (see the above Table), is 4.7 volts. For the $3.63 \times 10^8$ v/m field required for beryllia particles (see the Table) the anode voltage is 4.1 volts. In both cases the field is significantly in excess of the field Fo of equation (1) at $3.2 \times 10^7$, such that all traps are filled. It is important to note that those extractor anode potentials are about one-third that required to ionize gas molecules and hence gas molecules in the near space are not ionized and not electrostatically attracted to the tip.

NOISE OCCURRING IN EMISSION

In the prior art, four main types of noise in emitted current occur: Johnson noise, flicker noise, shot noise and burst noise. All are stochastic in nature, and follow different descriptive equations. In the prior art, the burst noise arising from created ions, adsorbing or ablating the emitting whisker, is the largest noise factor. In the present disclosure, no ions are created that can adsorb onto or ablate emitting insulator particles. Therefore, burst noise is eliminated as a noise source in the present device.

In the example used, 250 emitting insulator particles were assumed. More than 250, as many as 1,000 particles, can be made emitting. But, as an example, the 250 stochastically emitting particles reduce the current plus noise to noise ratio by the factor:

$$R = 1/(N)^{0.5} \quad (7)$$

where N is the number of emitting particles. As an example, 250 stochastically emitting particles reduce the current plus noise to noise ratio by:

$$R = 20 \log (N^{0.5}) = 24 \text{ decibels} \quad (8)$$

when N = 250 emitting insulator particles. The 24 db noise reduction over the prior art of the example is in addition to the reduced noise in the present device due to the elimination of ion produced burst noise. The remaining noise factors are sufficiently small that evaluation is trivial so that the present emitter is significantly improved in noise immunity.

ENERGY OF THE EMITTED ELECTRONS

The distribution of the energy of the emitted electrons can be calculated and compared with the prior art devices. The energy distribution is important because it is not reducible by the focus means. A large energy spread yields a larger resulting beam spot size. Because of the larger energy distribution in use of prior art emitters, a small aperture is usually inserted in the beam path to eliminate all but essentially on-axis electrons. That severely reduced available current. The width of the energy spread at half the maximum of the peak (FWHM) for cold field emission is given in the literature as:

$$FWHM = \Delta * 9.76 \times 10^{-11} Fi\phi^{0.5}/Ty \text{ in ev} \quad (9)$$

where Ty is a tabulated and calculable function of Y; and $$\Delta/2 = 0.693 \text{ at } 0° \text{ K.}$$

If comparison is made at maximum field Fmax (Y = 1, and Ty = 1.1107), then $$Fi = Fmax = 6.94 \times 10^8 Y^2 \phi^2 v/\text{m} \quad (10)$$

TABLE

FWHM ENERGY SPREAD OF FIELD EMITTERS BY MATERIALS

| Material | Barrier | Fmax v/m | FWHM ev |
|---|---|---|---|
| Tungsten | 4.5 ev | $1.406 \times 10^{10}$ | 3.634 |
| Molybdenum | 4.35 ev | $1.314 \times 10^{10}$ | 3.337 |
| Lanthanum hexaboride | 2.31 ev | $3.706 \times 10^9$ | 0.685 |
| Silica particles | 1.0 ev | $6.944 \times 10^8$ | 0.085 |
| Beryllia particles | 0.85 ev | $5.017 \times 10^8$ | 0.056 |

At lesser fields, the FWHM is also less; at greater fields, the FWHM is greater. The advantage of the present device emitting particles can be readily seen in the comparison Table.

The energy of emitted electrons is low, less than the applied extractor potential. Thus, the velocity of the electrons is also low, about that of 4 ev electrons. Such low energy makes the emitted electrons susceptible in some measure to ambient magnetic fields, and the earth's field. For that reason, an initial part of the structure of the device includes a grain-oriented permanent magnet, deposited with an aperture implicitly aligned to the vertical axis of the cermet tip. The magnet has very low induction, such that ambient magnetic fields negligibly change the permanent magnet field. The flux lines of the permanent magnet are parallel to the vertical axis of the cermet tip. Thus, electrons emitted off axis, or veering off axis due to lateral energy of emission, are steered onto the vertical axis. It is important to note also, that since the emitted electrons have low energy, if it were not for the permanent magnet field, most emitted electrons would be collected by the positively polarized extractor electrode. Premature current collection is often the case in the prior art, effectively reducing the target current density. It is of further value that the effect of the permanent magnet field, which extends beyond the height of the structure, has the opposite effect on ions. That is, unwanted ions created in acceleration space beyond the structure are steered off axis, away from the exit aperture of emitted electrons.

An advantage of the low velocity electrons is that they may be easily managed in micrometer distances by small beam control potentials. A potential of 5 volts across a micrometer space is an electrostatic field of 5 million volts per meter. Such small potentials are employed in both focus and deflection elements forming focused beam of electrons. Normally, it is difficult to achieve a focus crossover from a field emission source. The source size of a typical cold field emitter is in the range of a few angstroms, decreasing with increasing field. Upon emission from prior art field emitters, the emitted electron beam continues to spread. A type of focus is achieved by electromagnetic field confinement, and by apertures limiting the usable electrons to those emitted on axis. In the present device, the emitting area is N times that of the prior art yielding a a true cross-over focus. The lense structure employed is based on the principles published by K. Schlesinger, *Proceedings of the I.R.E., Transactions on Electon Devices,* "Focus Reflex Modulation of Electron Guns", May, 1961. The same type of lense structure is also known as a "saddle field" lense. That type of lense has much higher transmission efficiency, approaching 96% as compared to other lense types.

MATERIALS COMPRISING THE DEVICE

Insulators and conductors that fulfill the requirement for ohmic contact are not common in nature. The requirement for ohmic contact is that the work function of the insulator exceed the work function of the conductor. When an additional requirement, that the insulator conduction band width be less than 1 ev is imposed, the choices of materials are more severely restricted. Very acceptable work functions given below are at room temperature. The preferred materials for the particles in ohmic contact are trichromium ($Cr_3Si$ having a work function of 2.58 ev), and silica ($SiO_2$ having a work function 5 ev, barrier 1 ev) or beryllia (BeO wth a work function 4.7 ev, barrier 0.85 ev), for the insulator particles. Where every high currents are desired, silica is to preferred to beryllia. Where high currents with reduced beam spot size are desired, beryllia is preferred over silica. $Cr_3Si$ is also used in the process of making the device for an additional reason. $Cr_3Si$ has very high free surface energy and forms a strong bond with insulators, such as the polyimide (Hatchi brand PIQ or equivalent) used as an insulator layer in the device structure. Usual metals, such as aluminum, used as conductors, do not adhere to polyimide, which retains flexibility after deposition. The $Cr_3Si$ is used as an adherence layer, deposited a few nanometers in thickness onto polyimide. Then, a conductor thickness of aluminum, typically for low ohmic conduction, is deposited and sticks to $Cr_3Si$. Other conductor particles such as tantulum nitride (TaN having a work function 2.17 ev), or lanthanum hexaboride ($LaB_6$ having a crystalline work function 2.31 ev) can be used. The choice is a matter of economics. Since $Cr_3Si$ has other use in the structure fabrication, it is economical to use fewer materials rather than many different material. Other insulator particles may be used such as magnesia, calcium oxide and some rare earth oxides. But each of those choices has some auxiliary problem such as porosity (high trapping density) or sublimation in vacuum, or tendency toward phase problems in deposition of the insulator/conductor particles, not readily forming a random mixture. A final step in the structure fabrication procedure is sputter etching to insure that the insulator particles protrude from the surface. To accomplish that, the conductor particles must have a higher etching rate than the insulator particles. Oxides with low conductivity are thereby eliminated from consideration by this etching factor.

The material for the permanent magnet deposition is chosen for a high Curie temperature, so that the magnet recovers from vacuum baking at a temperature of 150° C. The vacuum bakeout removes moisture from the structure that otherwise would hinder operation. The magnet deposition process is molecular, by sputtering the magnetic material from a high coercive force permanent magnet. The magnetic material is sputtered onto the substrate. The substrate is temporarily backed by a similar permanent magnet with opposite pole facing the magnetic material source to initiate field alignment. Thus, sputtering off a nonaligned magnet produces a grain oriented, aligned magnet on the substrate. Ferrous oxide or alnico varieties are suitable materials.

ADVANTAGES OF THE DISCLOSED DEVICE

In summary of the above description, the device and structure of the present disclosure has the following advantages over the prior art:

A. orders of magnitude higher current;

B. orders of magnitude higher brightness because of higher current at orders of magnitude narrower electron energy distribution;

C. smaller achievable beam spot size resulting from narrower electron energy distribution;

D. much higher current-plus-noise to noise ratio, because of the multiplicity of stochastically emitting sources;

E. additional improvement in current-plus-noise to noise ratio because the burst noise due to ions has been eliminated;

F. potentials obtainable from common integrated circuits are suitable for all device control signals;

G. freedom from the effects of ambient magnetic fields; and

H. operation at and economies of 10 microtorr vacuum levels, as compared to nanotorr vacuum levels required by prior art.

DEFLECTION ELEMENTS AND FOCUS ANODES

The beam emitted from the conic of pyramid tip is shaped and deflected by elements which are arranged above the supportive substrate. Elements are shaped into focus elements and deflector bars around the emitting tip. Deflection is obtained by two pair of orthogonal coplanar deflector anodes. They are arranged as opposing pairs adjacent to the aperture. Moreover, they, as well as the other elements, are electrically insulated from each other. The deflection plates thus function jointly to deflect the beam within a specified sweep, and with applied offset voltages can function as an aperture lense.

The first anode is an encircling ring centered around the emitter tip. A voltage applied to the first anode creates a field and thus initiates electron emission. The magnet may be biased relative to the anode to alter the shape of the anode field. The exit element of saddle field lease is polarized to provide lense action by providing a radical restricting force and focusing the electron beam. The microgun structure thus includes the supportive substrate, the conic or pyramid tip, and the various elements described above. All of this apparatus will be termed hereinabove as a microgun. It finds use as a miniature scanning electron microscope in single quantity. It can be used in multiple arrays with a suitable target, one such arrangement being exemplified by the present inventor's U.S. Pat. No. 4,213,192.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a partial sectional view of a portion of the emitting surface and subsurface of the field emission device of the present disclosure;

FIG. 2 is a sectional view of the field emission device including substrate and various deflector elements and anodes;

FIG. 3 is a spatial arrangement of components acting on the emitted electron beam; and FIG. 4 is a chart of potentials applied to the various components of the field emission device.

DETAILED DESCRIPTION OF THE PREFERRED AND ILLUSTRATED EMBODIMENT

The microgun of this disclosure is suitably adapted to form an electron beam having a current density exemplified above, and is able to cooperate with a target exemplified in U.S. Pat. No. 4,213,192. The electron beam travels from the field emission device to the target in accordance with ballistic particle geometry in near vacuum space.

The microgun can be understood better by momentarily referring to FIG. 1 of the drawings. This sectional view discloses an emitting tip, greatly enlarged, and formed of a plurality of particles. The individual particles are up to about 5.0 nanometers or less in maximum diameter. The microgun device is generally identified by the numeral 40. The bottom layer 41 is a conductor layer made of the same material as particles 43 commingled in the cermet 42. The cermet is a mixture of individual particles, some being conductive material and some being insulative material. They are randomly distributed. The conductive dimension of the insulative particles is a noteworthy parameter partially defining the current density from the tip, this being developed hereinabove, and is made on averages of 3.5 nanometer. The tip is preferably about 80 nanometers or less in radius and has a solid angle of 60° or less. Another important factor is the molecular dimension of the material in both insulative and conductive particles. The deposition is preferably an ionic molecular process achieved at cold temperature to produce the particle dimensions desired, about 3.5 nanometers average in diameter. The conductive particles 43 are in ohmic contact with the insulative particles 44. The initial deposit of cermet material at 42 is biased in favor of conductive particles in ohmic contact with the bottom or support layer 41 and connects to a potential source 41 through a conductor layer 37. The layer 41 is preferably formed of the same or a similar conducting material as the particles 43. The deposition process forms the builtup tip with the multiple particle by dual vacuum particle emission with particle ballistics electrostatically directed and the surface is thereafter sputter etched to enhance insulator particle exposure. The conductive material has a higher sputter etching rate so it is partially removed and, on the completion of the sputter etching step, the exposed tip area or surface is mostly insulative particles. The insulative particles 44 initiate the electron flow into space from the conic member.

In summary, it will be observed that the materials are formed into a conic or pyramid section having a tip as the particles are electrostatically deposited into the circular opening to define the cold current emitter. There is a preference for conductive particles near the bottom of the pyramid. At the top, a bias or preference for insulative particles is manifested. They are all in ohmic contact with one another, and they typically have dimensions of about 3.5 nanometers or so up to a maximum of about 5.0 nanometers. Because they are in ohmic contact, there is conduction through the shaped conic or pyramid structure and into space.

Going now to FIGS. 1 and 2 jointly, it will be recalled that numeral 40 identifies the field emission device generally which has the upper cermet portion 42 above the conductive base portion 41. Moreover, the field emission device is shaped into a cone or pyramid with a tip. The tip does not come to a precise point, rather, it is truncated. The base is an ohmic contact with a conductor 31 insulated from or upon an insulator substrate 28. The emission device 40 is centered in an aperture 25. FIG. 2 shows several layers arranged above the aperture. The bottom layer is the substrate 28.

Proceeding upwardly from the bottom or supportive substrate 28, the next layer is an insulator layer 32. In turn, that supports the layer 31 of conductive material connected with the emitting microgun 40. Normally, the layer 28 is grounded while the layer 31 is connected to an acceleration voltage source such as shown in FIG. 4. The layer 30 is an insulator material. Preferred materials for the insulator layer 30 are polyimide while the layer 32 is an oxide layer.

The next layer 29 is the magnet layer deposition. It is placed just below the tip 42 to direct electrons away from the tip to initiate beam definition. The layer 29 is conductive material (discussed above) and also is part of the components forming a saddle field. The first anode 26 is formed into a circle around the aperture 25 extending to the base of the microgun. The circular conductive ring is sandwiched between adjacent insulative layers 27 and 17. The insulative layers are typically formed of polyimides. The first anode layer 26 is typically between about 0.15 and 0.6 microns thick. The layer 27 is typically about 0.3 to about 1.0 microns thick. Needless to say, the thickness is in part a function of the electron optical characteristics desired and that, in turn, depends on the use of the microgun. These are dimensional variations which can be readily scaled. Moreover, the layers 26, 27 and 29 may comprise layers used in the fabrication of the microgun structure as a sideboard extension to MOS or bipolar circuitry formed simultaneously in the fabrication of the microgun structure. The side board components define a control system.

Typically, the cermet 42 extends about 0.15 micrometer above the bottom plane of the first anode 26. The cermet emitter ideally terminates approximately within the thickness of the layer of the anode 26. The anode 26 is undercut as shown in FIG. 2 because there is no compelling need to make this layer thicker.

The structure of FIG. 2 is a sandwich of several deposited layers. The additional layers include a top located layer 14 formed into deflection bars above a polyimide insulator. This layer includes four bars to deflect the beam where the bars are pairs of spaced, parallel bars. The deflection bars are above an insulative layer 15. The deflection bars (two pair) are parallel edges spaced about 1.7 micrometer apart to define X and Y deflection bars at right angles. The two pair in the layer 14 are identified in FIG. 4 as the deflection bars 20 and 21. The conductive layer 16 (sandwiched above and below by insulators) is a lense or focus layer, acting to focus the emitted beam.

Going now to FIG. 3, wave forms of the various components are shown. FIG. 4 further shows in exploded view the various anodes with the insulative material omitted. Also, the target is shown but the evacuated housing has been omitted for sake of clarity. The beam shaping layers are represented in simplified fashion as being comprised of rings or bars with conductor paths extending to them. The several connective paths are shown extending to the side and bear numerals 51 to 58.

The numeral 51 identifies the terminal connected to the emitter 40. The magnet layer 29 connects to a selected voltage source. The anode 26 connects at the side of FIG. 4 to the terminal 52. The anode 26 is positive at a voltage slightly less than 5 volts. This initiates current emission from the emitter. Accordingly, the wave form 51 is switched to ground while the wave form 52 is switched to approximately 5 volts positive to initiate emission. The potentials applied to the opposing deflection bars or plates 20 are identified by the wave forms 54 and 55. The other opposing deflection plates 21 receive the potentials 53 and 58. It will be observed that these potentials are stepped up by a bias level. Thereafter, they are switched in opposite fashion. The step up in the wave forms 53, 54, 55 and 58 forms an aperture lense focusing voltage, narrowing the shape of the beam. The varied wave forms applied to the opposing focus electrodes are mirror images; this jointly deflects the beam in a controlled fashion and narrows the beam.

Focus, shaping and deflection is obtained by the step biases 60 applied to the wave forms 53, 54, 55 and 58. Beam modulation can be obtained by driving the anode 26 to a cutoff voltage, or to intermediate values to control the beam intensity. Beam focus or spot size can also be changed by adjusting the voltage applied to the lense in the layer 16. The target is spaced in FIG. 4 by a distance exceeding breakdown of the accelerating supply. All current flow is, therefore, beam emission.

It will be observed that all the voltage wave forms shown in FIG. 3 can be obtained through MOS or bipolar integrated circuits fabricated on a sideboard location. The control voltages applied to the deflector bars are in the millivolt range and these also can be obtained by sideboard located integrated circuits.

The foregoing is directed to the preferred embodiment. It has been described as a single device. It can be fabricated and used in single fashion, or it can be deployed in multiple arrays typically in rows and columns. The foregoing is directed to the preferred embodiment but the scope is determined by the claims which follow.

What is claimed is:

1. A field emission device wherein emission is obtained from particles of insulative material under the influence of a field, and wherein a barrier to emission is the conduction band width and is less than about 1 ev, and wherein the insulative particles are a component of a cermet of randomly arranged conductive and insulative particles, and ohmic contact exists between the particles.

2. The device of claim 1 wherein the insulative particles have an average diameter of about 3.5 nanometers.

3. The device of claim 1 wherein electrons in the insulative particles have at least the energy of the Fermi level of the conductive material, and energy imparted by an applied field to the electrons initiates emission.

4. The device of claim 3 wherein said field is sufficient to cause electron traps in said insulative particles to be overfilled, and all electrons flow in the insulative material conduction band.

5. The field emission device of claim 3 wherein said cermet comprises randomly arranged conductive particles conductively connected to randomly arranged insulative particles.

6. The field emission device of claim 4 wherein said cermet is formed upon a conductive substrate, and a separate conductor is spaced above and insulated from said substrate and said cermet, and a field is formed by a potential applied between said substrate and said separate conductor.

7. The field emission device of claim 3 wherein the cermet is formed into pointed structure and wherein the particles at the surface of the point are insulative particles.

8. The field emission device of claim 7 wherein said pointed structure is centered in an aperture of a conductive electrode, and said cermet is formed upon and conductively connected at a base to a conductive substrate and a potential applied between said substrate and conductive electrode operates on said point and said cermet to emit electron flow from said point.

9. The field emission device of claim 1 wherein the conductive material is refactory metal, nickel, silver, aluminum, rare earth borides, highly doped silicon or a silicide of refractory metal and having a lesser work function that that of said insulative material.

10. The field emission device of claim 1 wherein the insulative particles and the conductive particles have a maximum dimension of about 5.0 nanometers.

11. The field emission device of claim 1 wherein the radius conductive particles are trichromium silicide.

12. The device of claim 1 wherein the insulative material is $Al_2O_3$, BeO, $B_2O_3$, BN, CaO, MgO, $SiO_2$ or $Si_3N_4$.

13. The device of claim 12 wherein the insulative material has minimal affinity for oxygen or other gasses of the same electropolarity prohibiting chemisorption on the emitting particles which would otherwise cause noise or degradation of emission.

14. The field emission device of claim 6 wherein said potential is less than the ionization potential of gasses or vapors residual within or diffusing within said field preventing abalation by ionized particles of said point and resulting noise modulation of emission and degradation of emission levels.

15. A field emission device comprising a conductive substrate conductively connected to cermet of insulative and conductive particles of pyramidal or conical shape with a point centered in an aperture of a first conductor, and a potential is applied between said substrate and said first conductor forming a field causing electrons to flow through the cermet in the conduction band of the insulative particles with a barrier to emission of less than about 1 ev, the electron flow to the point of the cermet into vacuum being from insulative particles of the surface of the point, the potential producing the field for emission being less than the ionization potential of gasses or vapors residual within or diffusing within the field to preserve the integrity of the emitting insulative particles, reduce noise and emitted current degradation, and allow operation in the presence of vapors or gasses in the field.

16. The field emission device of claim 15 including two pairs of deflection bars orthogonal to and insulated from each other and from said first conductor, and said bars are centered relative to the emitting point; voltage means applied to one deflection pair; separate voltage means connected to the other deflection pair; and wherein said deflection bars are operative to deflect the emitted electrons and to focus the emitted electrons.

17. The field emission device of claim 16 wherein the spacing between the deflection bar pairs is less than 1.7 micrometer.

18. The field emission device of claim 16 wherein the voltage applied by said voltage means is less than the ionization potential of gasses or vapors.

19. A multiplicity of the field emission devices of claim 15 sharing a common substrate each directed to an assigned area of respective targets, and including integrated circuit control means integrally supported by said common substrate for the multiplicity of field emission devices.

20. The field emission devices of claim 19 wherein said integrated circuit means operates individual field emitters modulating and deflecting electron emission therefrom.

21. The field emission device of claim 16, wherein the deflection voltages supplied to the orthogonal deflection bars are controllably offset from a reference potential to focus the electron beam.

22. The field emission device of claim 15 wherein the emitting surface is multiplicity of insulative particles within a 60° solid angle point and said multiplicity of insulative particles simultaneously emit electrons.

23. The field emission device of claim 15 formed of trichromium silicide particles in ohmic contact with silica or beryllia particles.

24. The field emission device of claim 1 formed of trichromium silicide particles in ohmic contact with silica or beryllia particles.

* * * * *